US009091151B2

(12) United States Patent
Jones et al.

(10) Patent No.: US 9,091,151 B2
(45) Date of Patent: Jul. 28, 2015

(54) DOWNHOLE OPTICAL RADIOMETRY TOOL

(75) Inventors: Christopher M. Jones, Houston, TX (US); Stephen A. Zannoni, Houston, TX (US); Michael T. Pelletier, Houston, TX (US); Raj Pai, Houston, TX (US); Wei Zhang, Houston, TX (US); Marian L. Morys, Downingtown, PA (US); Robert Atkinson, Richmond, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 382 days.

(21) Appl. No.: 13/502,805

(22) PCT Filed: Nov. 18, 2010

(86) PCT No.: PCT/US2010/057172

§ 371 (c)(1),
(2), (4) Date: Apr. 19, 2012

(87) PCT Pub. No.: WO2011/063086

PCT Pub. Date: May 26, 2011

(65) Prior Publication Data

US 2012/0211650 A1 Aug. 23, 2012

Related U.S. Application Data

(60) Provisional application No. 61/262,895, filed on Nov. 19, 2009.

(51) Int. Cl.

| | |
|---|---|
| ***G01V 5/08*** | (2006.01) |
| ***E21B 47/10*** | (2012.01) |
| ***E21B 49/10*** | (2006.01) |

(52) U.S. Cl.
CPC ..... *E21B 47/102* (2013.01); *E21B 49/10* (2013.01)

(58) Field of Classification Search
CPC ..... E21B 47/102; E21B 49/10
USPC ..... 250/269.1
See application file for complete search history.

(56) References Cited

U.S. PATENT DOCUMENTS

| | | | |
|---|---|---|---|
| 223,898 | A | 1/1880 | Edison |
| 2,757,300 | A | 7/1956 | Laidig |

(Continued)

FOREIGN PATENT DOCUMENTS

| | | |
|---|---|---|
| AU | 2009356978 | 6/2011 |
| GB | 177816 | 3/1922 |

(Continued)

OTHER PUBLICATIONS

Faklaris, Orestis et al., "Comparison of the Photoluminescence Properties of Semiconductor Quantum Dots and Non-Blinking Diamond Nanoparticles. Observation of the Diffusion of Diamond Nanoparticlesin Living Cells", J. European Optical Society, v4, 2009, 8 pgs.

(Continued)

*Primary Examiner* — Kiho Kim
(74) *Attorney, Agent, or Firm* — Krueger Iselin LLP; Anthony Iannitelli

(57) ABSTRACT

Various methods and tools optically analyze downhole fluid properties in situ. Some disclosed downhole optical radiometry tools include a tool body having a sample cell for fluid flow. A light beam passes through the sample cell and a spectral operation unit (SOU) such as a prism, filter, interferometer, or multivariate optical element (MOE). The resulting light provides a signal indicative of one or more properties of the fluid. A sensor configuration using electrically balanced thermopiles offers a high sensitivity over a wide temperature range. Further sensitivity is achieved by modulating the light beam and/or by providing a reference light beam that does not interact with the fluid flow. To provide a wide spectral range, some embodiments include multiple filaments in the light source, each filament having a different emission spectrum. Moreover, some embodiments include a second light source, sample cell, SOU, and detector to provide increased range, flexibility, and reliability.

26 Claims, 6 Drawing Sheets

(56) References Cited

U.S. PATENT DOCUMENTS 2,972,251 A 2/1961 Harper
3,371,574 A 3/1968 Dwyer
3,449,546 A 6/1969 Dhoble
3,734,629 A 5/1973 Griffiths et al.
4,103,174 A 7/1978 McClatchie et al.
4,160,929 A 7/1979 Thorington et al.
4,370,886 A 2/1983 Smith, Jr. et al.
4,375,164 A 3/1983 Dodge et al.
4,499,955 A 2/1985 Campbell et al.
4,606,636 A 8/1986 Monin et al.
4,635,735 A * 1/1987 Crownover ..... 175/48
4,696,903 A 9/1987 Owen
4,722,612 A * 2/1988 Junkert et al. ..... 374/124
4,774,396 A 9/1988 Salit et al.
4,791,310 A * 12/1988 Honig et al. ..... 250/458.1
4,800,279 A 1/1989 Hieftje et al.
4,802,761 A 2/1989 Bowen et al.
4,839,516 A 6/1989 Freeman et al.
4,994,671 A 2/1991 Safinya et al.
4,996,421 A 2/1991 Rai et al.
5,126,570 A * 6/1992 Boos ..... 250/343
5,161,409 A 11/1992 Hughes et al.
5,166,747 A 11/1992 Schroeder et al.
RE34,153 E * 12/1992 Benner et al. ..... 356/301
5,167,149 A 12/1992 Mullins et al.
5,201,220 A 4/1993 Mullins et al.
5,258,620 A 11/1993 Sueyasu et al.
5,284,054 A 2/1994 Loebach
5,304,492 A 4/1994 Klinkhammer
5,306,909 A 4/1994 Jones et al.
5,331,156 A 7/1994 Hines et al.
5,331,399 A 7/1994 Tank et al.
5,341,207 A 8/1994 Tank et al.
5,360,738 A 11/1994 Jones et al.
5,368,669 A 11/1994 Maine et al.
5,457,259 A 10/1995 Elgarhy et al.
5,517,024 A 5/1996 Mullins et al.
5,557,103 A 9/1996 Hughes et al.
5,621,523 A 4/1997 Oobayashi et al.
5,729,013 A 3/1998 Bergren, III
5,790,432 A 8/1998 Morys
5,859,430 A 1/1999 Mullins et al.
5,912,459 A 6/1999 Mullins et al.
5,939,717 A 8/1999 Mullins
5,946,641 A 8/1999 Morys
6,006,844 A 12/1999 Van Puymbroeck et al.
6,023,340 A 2/2000 Wu et al.
6,040,191 A 3/2000 Grow
6,075,611 A 6/2000 Dussan et al.
6,140,637 A 10/2000 Mullins et al.
6,162,766 A 12/2000 Muir et al.
6,176,323 B1 1/2001 Weirich et al.
6,178,815 B1 1/2001 Felling et al.
6,181,427 B1 1/2001 Yarussi et al.
6,218,662 B1 4/2001 Tchakarov et al.
6,220,371 B1 4/2001 Sharma et al.
6,268,726 B1 7/2001 Prammer et al.
6,268,911 B1 7/2001 Tubel et al.
6,274,865 B1 8/2001 Schroer et al.
6,350,986 B1 2/2002 Mullins et al.
6,355,928 B1 3/2002 Skinner et al.
6,362,619 B2 3/2002 Prammer et al.
6,388,251 B1 5/2002 Papanyan
6,401,529 B1 6/2002 Robison et al.
6,403,949 B1 6/2002 Davis et al.
6,437,326 B1 8/2002 Yamate et al.
6,465,775 B2 10/2002 Mullins et al.
6,474,152 B1 11/2002 Mullins et al.
6,476,384 B1 11/2002 Mullins et al.
6,501,072 B2 12/2002 Mullins et al.
6,507,401 B1 1/2003 Turner et al.
6,518,756 B1 2/2003 Morys et al.
6,583,621 B2 6/2003 Prammer et al.
6,627,873 B2 9/2003 Tchakarov et al.
6,678,050 B2 1/2004 Pope et al.
6,683,681 B2 1/2004 DiFoggio et al.
6,704,109 B2 3/2004 Wu et al.
6,707,556 B2 3/2004 Turner et al.
6,714,872 B2 3/2004 DiFoggio et al.
6,729,400 B2 5/2004 Mullins et al.
6,765,384 B2 7/2004 Morys
6,768,105 B2 7/2004 Mullins et al.
6,788,066 B2 9/2004 Wisler et al.
6,794,652 B2 9/2004 Walkow
6,798,518 B2 9/2004 DiFoggio et al.
6,825,659 B2 11/2004 Prammer et al.
6,853,452 B1 * 2/2005 Laufer ..... 356/436
6,888,127 B2 5/2005 Jones et al.
6,927,846 B2 8/2005 Smith et al.
6,956,204 B2 10/2005 Dong et al.
6,967,322 B2 11/2005 Jones et al.
6,967,722 B2 11/2005 Manning
6,975,112 B2 12/2005 Morys et al.
6,988,547 B2 1/2006 Goodwin et al.
6,992,768 B2 1/2006 Dong et al.
6,995,360 B2 2/2006 Jones et al.
6,997,055 B2 2/2006 DiFoggio
7,002,142 B2 2/2006 Mullins et al.
7,016,026 B2 3/2006 DiFoggio et al.
7,061,168 B2 6/2006 Schmidt
7,081,615 B2 7/2006 Betancourt et al.
7,084,392 B2 8/2006 DiFoggio et al.
7,095,012 B2 8/2006 Fujisawa et al.
7,105,849 B2 9/2006 Prelewitz
7,142,306 B2 11/2006 Wu et al.
7,173,239 B2 2/2007 DiFoggio
7,195,731 B2 3/2007 Jones
7,196,786 B2 3/2007 DiFoggio
7,210,343 B2 5/2007 Shammai et al.
7,214,933 B2 5/2007 DiFoggio et al.
7,243,536 B2 7/2007 Bolze et al.
7,245,382 B2 7/2007 Ronnekleiv
7,248,370 B2 7/2007 Jones
7,251,037 B2 7/2007 Jones
7,279,678 B2 10/2007 Andrews et al.
7,280,214 B2 10/2007 DiFoggio et al.
7,293,613 B2 11/2007 Goldberg et al.
7,299,136 B2 11/2007 DiFoggio et al.
7,305,306 B2 12/2007 Venkataramanan et al.
7,315,377 B2 1/2008 Holland et al.
7,336,356 B2 2/2008 Vannuffelen et al.
7,337,660 B2 3/2008 Ibrahim et al.
7,347,267 B2 3/2008 Morys et al.
7,362,422 B2 4/2008 DiFoggio et al.
7,372,264 B2 5/2008 Akkurt et al.
7,377,217 B2 5/2008 Swanson
7,387,021 B2 6/2008 DiFoggio
7,395,704 B2 7/2008 DiFoggio
7,398,159 B2 7/2008 Venkataramanan et al.
7,408,645 B2 8/2008 DiFoggio
7,423,258 B2 9/2008 DiFoggio et al.
7,440,098 B2 10/2008 Christian et al.
7,461,547 B2 12/2008 Terabayashi et al.
7,475,593 B2 1/2009 Odom
7,482,811 B2 1/2009 Freedman et al.
7,484,563 B2 2/2009 Zazovsky et al.
7,490,428 B2 2/2009 Morys
7,490,664 B2 2/2009 Skinner et al.
7,498,567 B2 3/2009 Brady
7,508,506 B2 3/2009 Christian et al.
7,511,813 B2 3/2009 Vannuffelen et al.
7,511,819 B2 3/2009 DiFoggio
7,511,823 B2 3/2009 Schultz et al.
7,520,158 B2 4/2009 DiFoggio
7,526,953 B2 5/2009 Goodwin et al.
7,530,265 B2 5/2009 DiFoggio
7,532,129 B2 5/2009 Radzinski
7,542,142 B2 6/2009 Wu et al.
7,571,644 B2 8/2009 Ibrahim et al.
7,576,856 B2 8/2009 DiFoggio
7,579,841 B2 8/2009 San Martin et al.
7,595,876 B2 9/2009 DiFoggio
7,601,950 B2 10/2009 Kischkat et al.
7,609,380 B2 10/2009 Vannuffelen et al.

(56) References Cited

U.S. PATENT DOCUMENTS

| | | | | |
|---|---|---|---|---|
| 7,696,756 | B2 | 4/2010 | Morys et al. | |
| 7,697,141 | B2 | 4/2010 | Jones et al. | |
| 7,762,131 | B2 | 7/2010 | Ibrahim et al. | |
| 7,784,350 | B2 | 8/2010 | Pelletier | |
| 7,800,513 | B2 | 9/2010 | Morys | |
| 7,938,175 | B2 | 5/2011 | Skinner et al. | |
| 7,976,780 | B2 | 7/2011 | Elrod et al. | |
| 2003/0048441 | A1 | 3/2003 | Manning | |
| 2004/0023407 | A1 | 2/2004 | Casal et al. | |
| 2004/0069942 | A1 | 4/2004 | Fujisawa et al. | |
| 2004/0152028 | A1 | 8/2004 | Singh et al. | |
| 2004/0159002 | A1 | 8/2004 | Carlucci et al. | |
| 2005/0007583 | A1 | 1/2005 | DiFoggio | |
| 2005/0019955 | A1 | 1/2005 | Dahl et al. | |
| 2005/0052105 | A1 | 3/2005 | Schmidt | |
| 2005/0099618 | A1 | 5/2005 | DiFoggio et al. | |
| 2005/0213313 | A1 | 9/2005 | Baumberg et al. | |
| 2006/0052963 | A1 | 3/2006 | Shkarlet | |
| 2006/0142955 | A1* | 6/2006 | Jones et al. | 702/32 |
| 2007/0035736 | A1 | 2/2007 | Vannuffelen et al. | |
| 2007/0103162 | A1 | 5/2007 | Morys et al. | |
| 2008/0106176 | A1 | 5/2008 | Andorfer et al. | |
| 2008/0125335 | A1 | 5/2008 | Bhavsar | |
| 2008/0297808 | A1 | 12/2008 | Riza et al. | |
| 2009/0095529 | A1 | 4/2009 | Rezgui et al. | |
| 2009/0107667 | A1 | 4/2009 | Mullins et al. | |
| 2009/0120637 | A1 | 5/2009 | Kirkwood et al. | |
| 2009/0151939 | A1 | 6/2009 | Bailey et al. | |
| 2009/0199630 | A1 | 8/2009 | DiFoggio et al. | |
| 2009/0288820 | A1 | 11/2009 | Barron et al. | |
| 2010/0148787 | A1 | 6/2010 | Morys et al. | |
| 2010/0153048 | A1 | 6/2010 | Myrick et al. | |
| 2010/0231225 | A1 | 9/2010 | Morys et al. | |
| 2010/0265094 | A1 | 10/2010 | Zannoni et al. | |
| 2011/0023594 | A1 | 2/2011 | Pelletier et al. | |
| 2011/0181870 | A1 | 7/2011 | Penney et al. | |
| 2011/0251794 | A1 | 10/2011 | Bittar et al. | |
| 2012/0018152 | A1 | 1/2012 | Zuilekom et al. | |
| 2012/0150451 | A1 | 6/2012 | Skinner et al. | |
| 2012/0211650 | A1 | 8/2012 | Jones et al. | |
| 2013/0087723 | A1 | 4/2013 | Pelletier et al. | |

FOREIGN PATENT DOCUMENTS

| | | |
|---|---|---|
| GB | 310895 | 10/1930 |
| GB | 1088268 | 10/1967 |
| GB | 2064217 | 6/1981 |
| GB | 2441069 | 2/2008 |
| JP | H0227686 | 1/1990 |
| JP | 2003157807 | 5/2003 |
| WO | WO-2004/003984 | 1/2004 |
| WO | WO-2011/063086 | 5/2011 |
| WO | WO-2011/078869 | 6/2011 |
| WO | WO-2011/153190 | 12/2011 |
| WO | WO-2011/159289 | 12/2011 |
| WO | WO-2012/161693 | 11/2012 |

OTHER PUBLICATIONS

Myrick, M. L., et al., "Application of Multivariate Optical Computing to Simple Near-Infrared Point Measurements", Proceedings of SPIE, vol. 4574, (2002), pp. 208-215.

Zhang, Wei et al., "Downhole Optical Fluid Analyzer Having Intermittently Driven Filter Wheel", PCT Appl No. US11/37662, filed May 24, 2011, 11 pgs.

Zhang, Wei et al., "Method to Increase the Number of Filters per Optical Path in a Downhole Spectrometer", PCT Appl No. PCT/US11/03655, filed May 24, 2011, 12 pgs.

PCT International Preliminary Report on Patentability, dated Jan. 3, 2013, Appl No. PCT/US10/038747, "Downhole Sources Having Enhanced IR Emission", filed Jun. 16, 2010, 7 pgs.

First CN Office Action, dated Feb. 5, 2013, Appl No. 200980157701.3, "Interferometry-Based Downhole Analysis Tool", filed Dec. 23, 2009, 13 pgs.

US Non-Final Office Action, dated Mar. 26, 2013, U.S. Appl. No. 13/147,478, "Interferometry-Based Downhole Analysis Tool", filed Dec. 23, 2009, 18 pgs.

Canadian Examiner Letter, dated Oct. 24, 2012, Appl No. 2,756,285, "Interferometry-Based Downhole Analysis Tool", filed Dec. 23, 2009, 2 pgs.

US Final Office Action, dated May 31, 2013, U.S. Appl. No. 13/147,478, "Interferometry-Based Downhole Analysis Tool", filed Dec. 23, 2009, 18 pgs.

AU First Examination Report, dated Jun. 24, 2013, Appl No. 2010355321, "Downhole Sources Having Enhanced IR Emission", filed Jun. 6, 2010, 3 pgs.

Non-Final Office Action, dated Jul. 2, 2013, U.S. Appl. No. 13/510,231, "Downhole Sources Having Enhanced IR Emission", filed May 16, 2012, 38 pgs.

Supplementary European Search Report, dated Sep. 2, 2013, Appl No. 10853352.2, "Downhole Sources Having Enhanced IR Emissions", filed Jun. 16, 2010, 13 pgs.

US Non-Final Office Action, dated Sep. 24, 2013, U.S. Appl. No. 13/147,478, "Interferometry-Based Downhole Analysis Tool", filed Dec. 23, 2009, 22 pgs.

CA Examiner'S Letter, dated Jul. 31, 2013, Appl No. 2,781,331, "Downhole Sources Having Enhanced IR Emission", filed May 16, 2012, 6 pgs.

European Search Report, dated Dec. 12, 2013, Appl No. 09852686.6, "Interferometry-Based Downhole Analysis Tool", filed Dec. 23, 2009, 7 pgs.

US Final Office Action, dated Apr. 4, 2014, U.S. Appl. No. 13/147,478, "Interferometry-Based Downhole Analysis Tool," filed Aug. 2, 2014, 25 pgs.

US Final Office Action, dated Apr. 17, 2014, Appl No. 2013/510,231Downhole Sources Having Enhanced IR Emission, filed May 16, 2012, 18 pgs.

CN Notice of First Office Action, dated Sep. 12, 2014, Appl No. 201080065565.8, "Downhole Sources Having Enhanced IR Emission," Filed Jun. 16, 2010, 21 pgs.

AU Examination Report No. 1, dated Nov. 11, 2014, Appl No. 2014200604, "Downhole Sources Having Enhanced IR Emission," Filed Jun. 16, 2010, 2 pgs.

* cited by examiner

FIG. 1
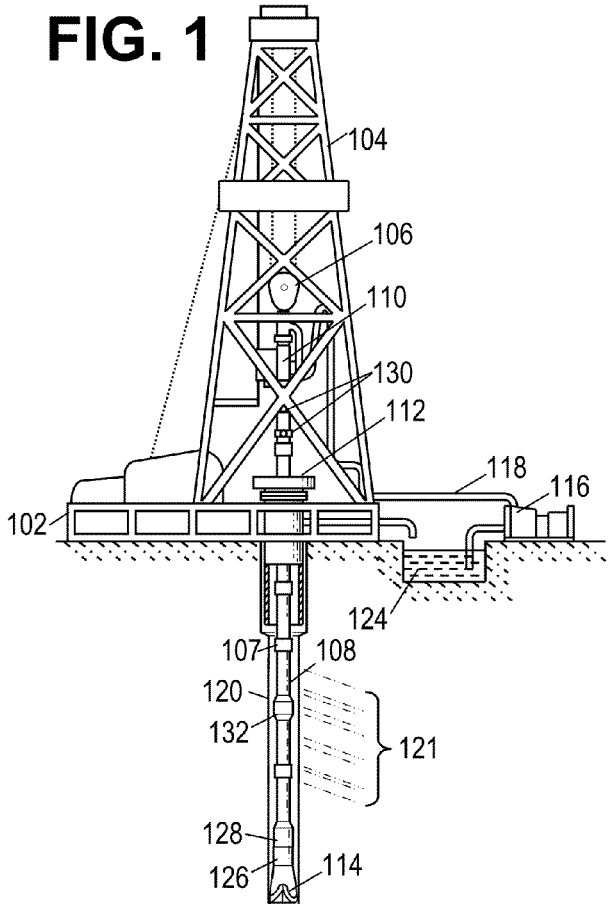
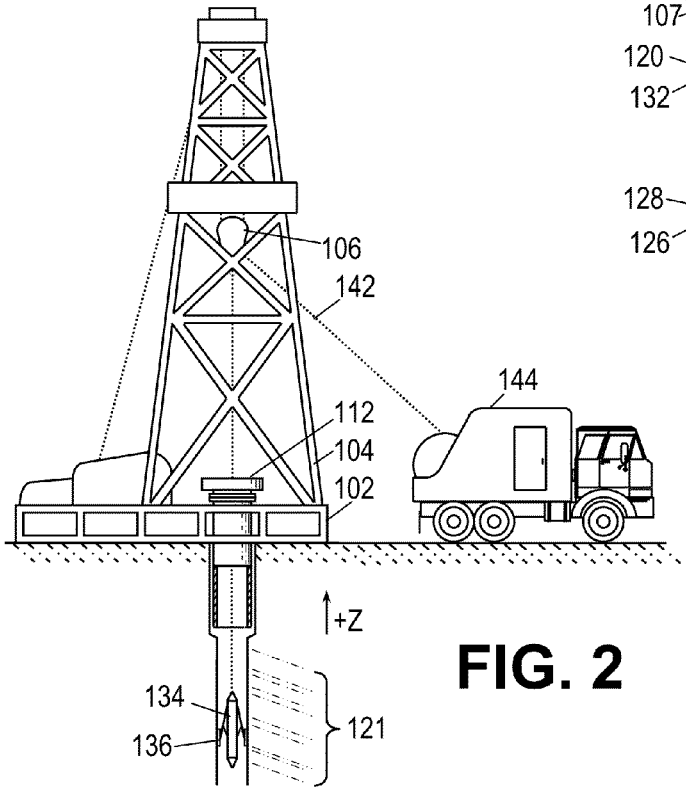
FIG. 2

DOWNHOLE OPTICAL RADIOMETRY TOOL

CROSS-REFERENCE TO RELATED APPLICATIONS

The present application claims priority to U.S. Provisional Patent Application 61/262,895, filed Nov. 19, 2009, by Inventors Christopher M. Jones, Stephen A. Zannoni, Michael T. Pelletier, Raj Pai, Wei Zhang, Marian L. Morys, and Robert Atkinson. The foregoing application is hereby incorporated by reference.

BACKGROUND

Spectroscopic analysis is popular method for determining compositions of fluids and other materials in a laboratory environment. However, implementing spectroscopic analysis in a downhole tool is a difficult task due to a number of obstacles, not the least of which is the great range of operating temperatures in which the tool must operate. If such obstacles were adequately addressed, a downhole optical radiometry tool could be used to analyze and monitor different properties of various fluids in situ.

For example, when formation fluid sampling tools draw fluid samples there is always a question of how much contamination (e.g., from drilling fluid in the borehole) exists in the sample stream and how much pumping must be done before the contamination level drops to an acceptable level. A downhole optical radiometry tool can measure various indicators of contamination, identify trends, and determine a completion time for the sampling process. Further, the downhole optical radiometry tool could be used to characterize the fluid composition to measure, e.g., water, light hydrocarbons, a distribution of hydrocarbon types (e.g., the so-called SARA measurement of saturated oils, aromatics, resins, and asphaltenes), $H_2S$ concentrations, and $CO_2$ concentrations. Moreover, PVT properties can be predicted, e.g., by measurements of Gas-Oil Ratios. The fluid compositions can be compared to those of fluids from other wells to measure reservoir connectivity. Such measurements can be the basis for formulating multi-billion dollar production strategies and recovery assessments, so accuracy and reliability are key concerns.

BRIEF DESCRIPTION OF THE DRAWINGS

The following detailed description should be considered in conjunction with the accompanying drawings, in which:

FIG. 1 shows an illustrative logging while drilling (LWD) environment;

FIG. 2 shows an illustrative wireline environment;

Figure 3:
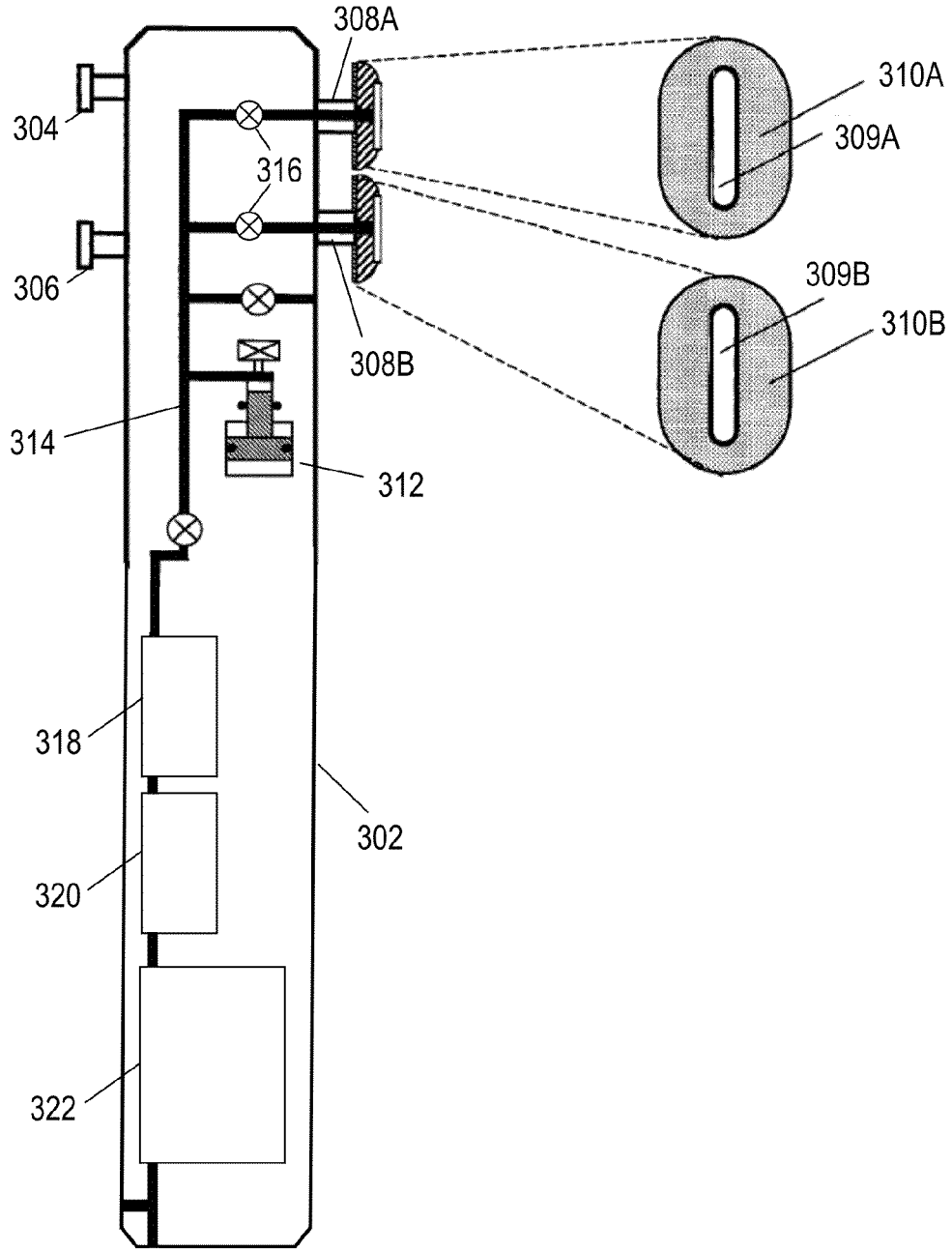
FIG. 3 shows an illustrative downhole optical radiometry wireline tool.

It is noted that the drawings and detailed description are directed to specific illustrative embodiments of the invention. It should be understood, however, that the illustrated and described embodiments are not intended to limit the disclosure, but on the contrary, the intention is to cover all modifications, equivalents and alternatives falling within the scope of the appended claims.

DETAILED DESCRIPTION

Accordingly, disclosed herein are various embodiments for a method and tool to optically analyze downhole fluid properties in situ. In at least some embodiments, a disclosed downhole optical radiometry tool includes a tool body having a downhole sample cell for fluid flow. A light source transmits a light beam through the fluid flow and a spectral operation unit (SOU) such as a prism, filter, interferometer, or multivariate optical element (MOE). The resulting light strikes at least one of multiple electrically balanced thermopiles, producing a signal indicative of one or more properties of the fluid. The balanced thermopiles enable a high degree of sensitivity over a wide temperature range. Further sensitivity can be provided by maintaining the thermopile substrates at a constant temperature, modulating the light downstream of the sample cell, and/or by providing a reference light beam that does not interact with the fluid flow. To provide a wide spectral range, some tool embodiments include multiple filaments in the light source, each filament having a different emission spectrum. The light from such wideband light sources can be better collimated using mirrors and apertures instead of lenses. Moreover, some tool embodiments include a second light source, sample cell, SOU, and detector to provide increased range, flexibility, and reliability. The tool can be a wireline tool, a tubing-conveyed tool, or a logging while drilling (LWD) tool.

In at least some embodiments, a disclosed downhole fluid analysis method includes: passing a sample of fluid through a downhole sample cell where a light beam interacts with said sample fluid; and receiving the light beam with a light detector after the light beam passes through a spectral operation unit (SOU). The light detector can include two electrically balanced thermopiles with at least one thermopile shielded from the light beam. Some method and tool embodiments employ a wheel having multiple SOUs that can be sequentially moved into the light path to provide measurements of different fluid properties. In some configurations, the wheel can in some cases surround a central flow passage through the tool.

These and other aspects of the disclosed tools and methods are best understood in the context of the larger systems in which they operate. Accordingly, an illustrative logging while drilling (LWD) environment is shown in FIG. 1. A drilling platform 102 is equipped with a derrick 104 that supports a hoist 106 for raising and lowering a drill string 108. The hoist 106 suspends a top drive 110 that is used to rotate the drill string 108 and to lower the drill string through the well head 112. Sections of the drill string 108 are connected by threaded connectors 107. Connected to the lower end of the drill string 108 is a drill bit 114. As bit 114 rotates, it creates a borehole 120 that passes through various formations 121. A pump 116 circulates drilling fluid through a supply pipe 118 to top drive 110, downhole through the interior of drill string 108, through orifices in drill bit 114, back to the surface via the annulus around drill string 108, and into a retention pit 124. The drilling fluid transports cuttings from the borehole into the pit 124 and aids in maintaining the integrity of the borehole 120.

Some wells can employ acoustic telemetry for LWD. Downhole sensors (including downhole optical radiometry tool 126) are coupled to a telemetry module 128 including an acoustic telemetry transmitter that transmits telemetry signals in the form of acoustic vibrations in the tubing wall of drill string 108. An acoustic telemetry receiver array 130 may be coupled to tubing below the top drive 110 to receive transmitted telemetry signals. One or more repeater modules 132 may be optionally provided along the drill string to receive and retransmit the telemetry signals. Other telemetry techniques that can be employed include mud pulse telemetry, electromagnetic telemetry, and wired drill pipe telemetry.

At various times during the drilling process, the drill string 108 is removed from the borehole as shown in FIG. 2. Once the drill string has been removed, logging operations can be conducted using a wireline logging tool 134, i.e., a sensing instrument sonde suspended by a cable 142 having conductors for transporting power to the tool and telemetry from the tool to the surface. An optical radiometry portion of the logging tool 134 may have extendable arms 136 that provide sealing contact with the borehole wall and enable the tool to withdraw samples of fluid from the formation and selectable positions along the borehole. A logging facility 144 collects measurements from the logging tool 134, and includes computing facilities for processing and storing the measurements gathered by the logging tool.

FIG. 3 shows an illustrative wireline tool 302 for formation fluid sampling and analysis using a downhole optical radiometry tool. Tool 302 includes rams 304 and 306 that move laterally to press the tool towards the opposite borehole wall, thereby enabling probes 308A and 308B to make contact with that wall. The probes each have an opening 309A, 309B surrounded by a respective cup-shaped sealing pad 310A, 310B. A piston pump 312 draws fluid into flow line 314 from the formation via either of the probes. Flow line 314 includes various valves 316 that work cooperatively with pump 312 to direct the fluid from flow line 314 to a desired branch. In this manner, pump 312 can exhaust the fluid from tool 302 or direct the fluid along flow line 314 to downhole optical radiometry tool 318. A second downhole optical radiometry tool 320 is shown in series with tool 318, but in alternative embodiments it is selectably coupled in a parallel arrangement. The flow line 314 continues to a multi-chamber sample collection module 322 that enables the tool 302 to collect multiple samples for retrieval to the surface. Further branches in flow line 314 can connect to other modules and/or secondary exhaust ports.

As explained in greater detail below, the optical radiometry tools 318, 320 in tool 302 enable downhole measurement of various fluid properties including contamination level, gas concentration, and composition. Such measurements can be employed in deciding whether and when to take or keep a fluid sample for transport to the surface, and can even assist in determining repositioning of the tool for additional sampling operations. The inclusion of two tools offers an increased range of flexibility in the measurements that can be performed by the tool and/or increased reliability or resolution through the use of redundant components. Moreover, the use of two tools at different points on the flow line enables monitoring of fluid flow dynamics including flow velocities of different fluid phases.

Figure 4A:
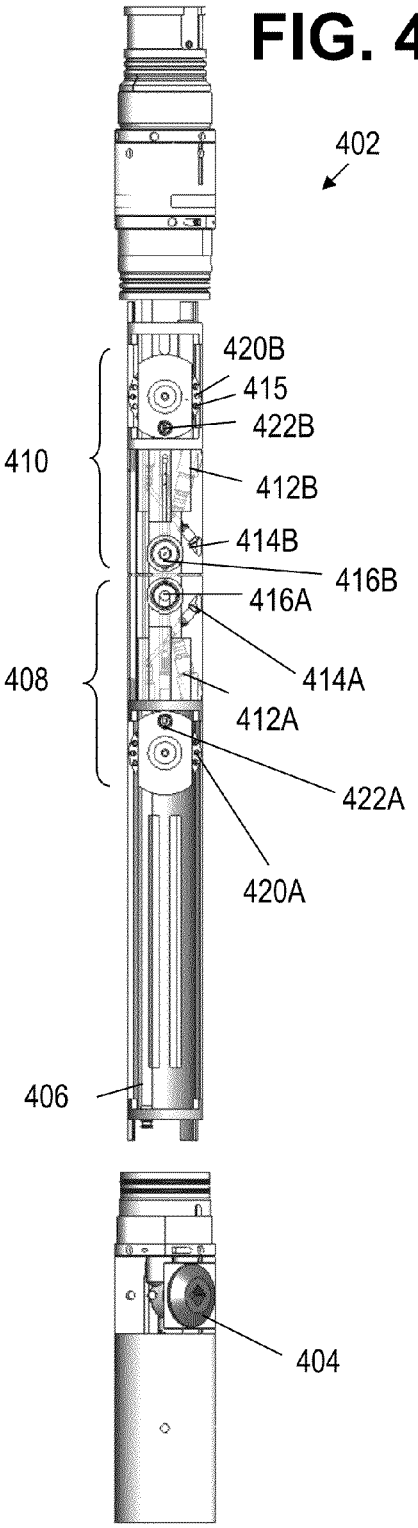
FIGS. 4*a* and 4*b* show a second illustrative downhole optical radiometry wireline tool embodiment.
Figure 4B:
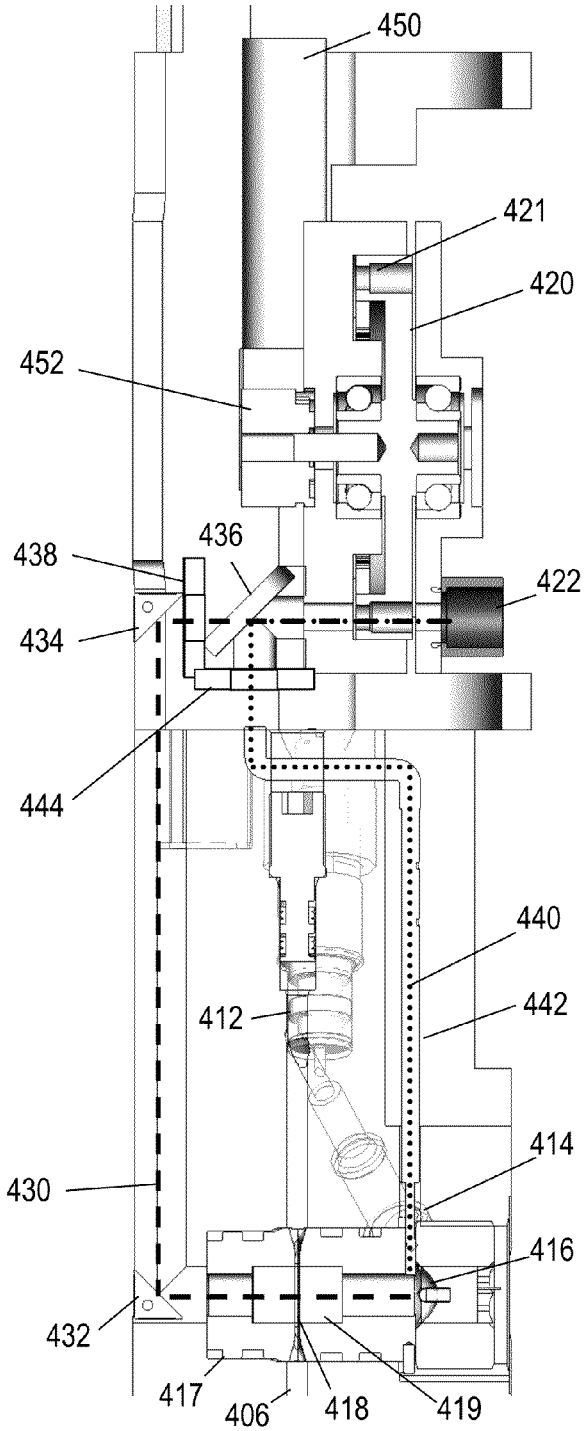

FIGS. 4A and 4B show an alternative wireline tool embodiment in partially disassembled and cutaway views that offer greater detail. Tool 402 includes an extensible probe 404 with a sealing face surrounding an aperture that connects to a flow line 406. Flow line 406 conducts fluid to two downhole optical radiometry tools 408, 410. Each radiometry tool includes a corresponding piston pump 412 that can draw fluid from flow line 406 into a sample cell and then direct it to a subsequent module or to an exhaust port 414.

FIG. 4B shows a cross-sectional side view of optical radiometry tool 410. This view demonstrates the connection of flow path 406 to a sample cell 417 having a flow passage 418 between two windows 419 and onward to pump 412. A light source 416 shines light on a parabolic collimating mirror that directs the light along a primary light path 430. The primary light path passes through fluid in the sample cell 417 via windows 419 before being directed by mirrors 432, 434 to a detector 422. Just before striking the detector, the light path passes through one of multiple spectral operation units 421 in a circular wheel 420. Some tool embodiments include a light collector to concentrate light from the spectral operation unit onto the detector. While a lens could serve this function, a parabolic reflector may be preferred.

A secondary light path 440 is formed by a light guide 422 that intercepts a non-collimated portion of the light from light source 416 and directs it to a beam splitter 436, which in this case operates to combine the primary and secondary light paths on the last segment through the circular wheel 420 to the detector 422. Suitable materials for the beam splitter include zinc sulfide and zinc selenide. Shutters 434 and 444 can selectively gate light from the primary and secondary light paths. Since light from both paths can be alternately directed onto the detector, the tool can compensate for aging, temperature, and other effects on the various system components including variation of the light source intensity and spectrum.

In an alternative embodiment, a movable mirror place of the beam splitter 436 can eliminate the need for shutters 434 and 444. In addition to selecting one of the light paths, the shutters or movable mirror can be used to modulate the light signal before it strikes the detector, an operation which may offer increased measurement sensitivity. Alternatively, modulation could be provided using a chopper wheel (a rotating disk having spokes to alternately block and pass light traveling along the optical axis).

A motor 450 turns the wheel 420 via a gearing arrangement that includes a position resolver 452. The resolver 452 enables the tool electronics to track the position of the wheel 420 and thereby determine which (if any) SOU is on the optical axis. In some embodiments, the wheel 420 includes an open aperture 415 (see FIG. 4A) to enable calibration of the light detector 422.

In at least some embodiments, the light source 416 takes the form of an electrically heated tungsten filament (e.g., in a tungsten halogen bulb) that produces a broad spectrum of electromagnetic emissions including visible and infrared wavelengths. The emission spectrum mimics a blackbody radiation curve. The filament is trapped in a small insulated volume to improve the heating efficiency. The volume is windowed by a transparent material (such as quartz, sapphire, ZnS) to help trap heat, while enabling light to escape. The filament may also be altered in composition to improve performance. Other materials may include tungsten alloys or carbon with carbon nanostructures being the most probable candidates. Potentially, the light source's bulb may include photonic crystals or blackbody radiators to convert some of the visible radiation into IR radiation, thereby enhancing the source's intensity in the IR band.

A series of reflectors collimates light from the light source and directs it along the primary light path (sometimes referred to herein as the optical axis). The reflectors can be designed to provide relatively uniform intensity across a region of investigation in the sample cell, or in some cases they can be designed to concentrate the light to a line or sharp point focus to promote an interaction with the fluid. For example, a line focus can be provided using an elongated parabolic trough. The light incident on the SOUs can similarly be given a relatively uniform intensity distribution or brought to a line or sharp point focus. Strong collimation is not crucial to the tool's operation. Some contemplated tool embodiments provide only a moderate degree of collimation (with a divergence half angle of up to 30°) and use a short waveguide as an integrating rod to contain and homogenize the emitted light.

A portion of the emitted light can be diverted and routed along a separate optical path to the detector to act as a reference beam. In addition or as an alternative to reflectors, optical light pipes (e.g., waveguides or optical fibers) can be used to guide the primary and/or secondary light beams along portions of their routes. Such an optical light pipe 442 is shown in FIG. 4B. Where feasible, air is evacuated from the light paths, though in some contemplated embodiments the tool cavity is pressurized with argon or nitrogen. Among the contemplated optical fiber types are fluoride fiber, sapphire fiber, chalcogenide fiber, silver halide fiber, low OH fibers, photonic crystal fibers (a.k.a. "holey fibers"), and hollow wave guide fiber. Solid rods of calcium fluoride and sapphire, with and without metalized surfaces (e.g., a gold coating), are also contemplated, and they may provide an additional benefit of increased light beam homogenization. Specifically contemplated fibers include MIR FluoroZirconate Fibers, IR chalcogenide fibers, IR Silver halide fibers, and IR Sapphire fibers from Sedi Fibres Optique of Courcouronnes, France; IR fibers from Le Verre Fluore of Brittany, France; Hollow Silica Waveguide (HSW) from Polymicro Technologies of Phoenix, Ariz.; IRphotonics materials (including UVIR™ fluoride glass) from iGuide of Hamden Conn.; and sapphire fibers from Photran of Poway, Calif. Of course other suitable materials and methods for directing light along desired paths through the tool exist and can be used.

In FIG. 4B, sample cell 417 takes the form of a windowed flow passage. The collimated light impinges a sample cell formed by a set of windows within a pressure housing to contain a fluid flow. Suitable materials for the windows include sapphire material, ZnS material, diamond material, zirconium material or carbide material. Sapphire material in particular offers desirable innate optical properties (such as low reflection loss), strength, and chemical inertness. Other materials listed present other attractive optical properties as well. A combination of materials may be used to maximize desired performance characteristics. Some tool embodiments provide the window surfaces in contact with the sample fluid with a coating of material such as Sulfinert™ to reduce chemical activity of the fluid while maintaining desired optical properties. The windows can be coated for anti-reflection properties. Some contemplated tool embodiments shape the receiving face of the window nearest the light source as a lens to improve optical characteristics of the spot. The faces of the sample cell windows abutting the fluid flow may be planar to maximize flow uniformity. Similarly the departure face of the window furthest from the light source can be shaped to improve the collimation of the light beam.

In at least some embodiments, the desired spot size (measured perpendicular to the optical axis in the center of the sample cell) is greater than ⅜ inch and less than ½ inch. The desired collimation is less than 7.5 RMS angular distribution within the spot with less than 3 RMS being more desirable. A homogenization of better than 10% RSD is most desirable within the spot with better than 5% being more desirable. An efficiency of better than 50% collimated power within the spot size (total emission—filament absorption) is desirable with better than 60% being more desirable and greater than 70% being most desirable.

The optical windows in sample cell 417 are sealed into an Inconel pressure vessel with brazing of sapphire to Inconell envisioned as the current method. Alternative methods include gasket seals on a front window etched for positive pressure, or compressive o-ring seals which may include compressive spacers and/or gaskets. The envisioned transmission gap is seen as 1 mm with 0.5 mm to 2.5 mm being the contemplated range of possibly suitable gaps. In some embodiments, the inner window surfaces provide a variable gap distance to enable detection of fluids of wide optical densities. The optical densities are expected to vary from 0.1 to 10 optical density normally with up to 60 optical density units at times. The variable path length may be achieved by varying the shape of the second receiving window surface in contact with the fluid.

The spectral operation units (SOUs) 421 are shown interacting with the light after it has passed through the sample cell. (This configuration is not required, as it would be possible to have the light pass through the SOU before entering the sample cell.) As the light interacts with the fluid, the light spectrum becomes imprinted with the optical characteristics of the fluid. The interaction of the light with the fluid is a transformation of the optical properties of the light. The SOU provides further processing of the light spectrum to enable one or more light intensity sensors to collect measurements from which properties of the fluid can be ascertained.

Figure 5A:
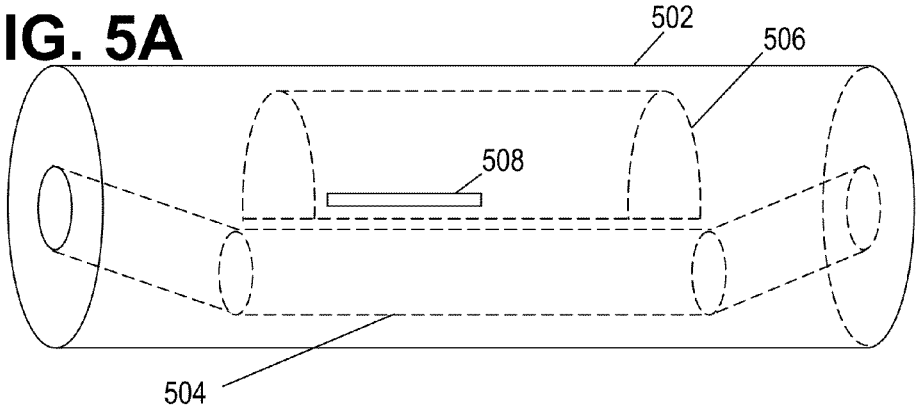
FIG. 5*a* shows a first illustrative LWD tool embodiment.

The tool embodiments illustrated in FIGS. 3 and 4 are wireline tool embodiments. FIG. 5A shows an illustrative logging while drilling tool embodiment 502 having a flow passage 504 for drilling fluid. Also shown is a cavity for a downhole optical radiometry tool 506, which can be used for analyzing formation fluid samples, borehole fluids, and/or fluids passing through the flow passage 504. In tool 502, the flow passage 504 deviates from the central axis of the tool body. Such deviation enables downhole radiometry tool to employ a larger circular wheel 508 of SOUs. The wheel 508 has an axis oriented perpendicular to the axis of the tool body, and the allowable diameter for the wheel is maximized when the wheel is near the axis of the cylindrical tool body.

Figure 5B:
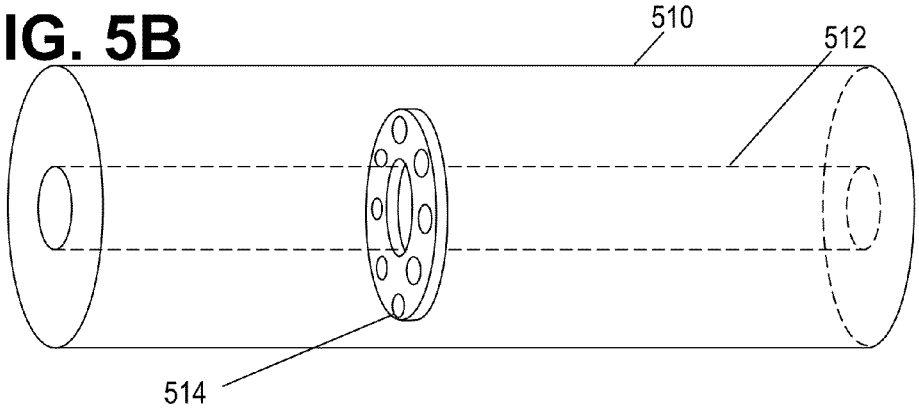
FIGS. 5*b* and 5*c* show a second illustrative LWD tool embodiment.
Figure 5C:
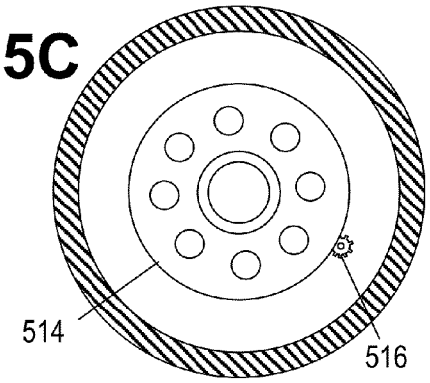

However, it may in some cases be undesirable to have the flow passage deviate from the central axis of the tool body. Accordingly, FIG. 5*b* illustrates an alternative logging while drilling tool embodiment 510 having a flow passage 512 along the central axis. A downhole optical radiometry tool in this situation could employ a circular wheel 514 of SOUs that surrounds the central flow passage. As illustrated in FIG. 5C, the wheel assumes the form of an annular ring. A drive gear 516 can rotate the annular ring from the inner or outer rim. In either case, the number of SOUs that can be fit into the wheel is increased to enable a greater range of fluid property measurements.

Figure 6:
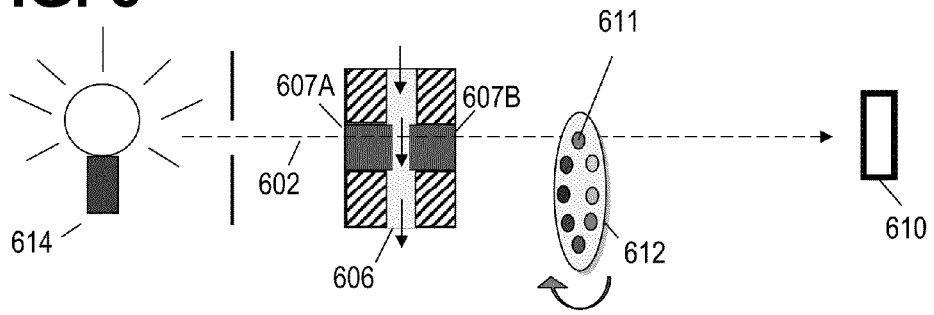
FIG. 6 shows a first illustrative optical radiometry tool configuration.
Figure 7:
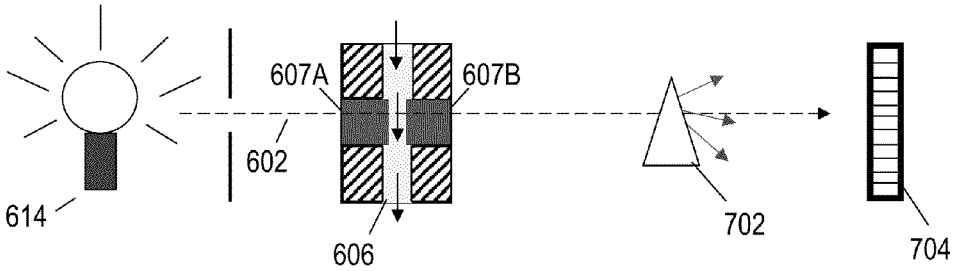
FIG. 7 shows a second illustrative optical radiometry tool configuration.
Figure 8:
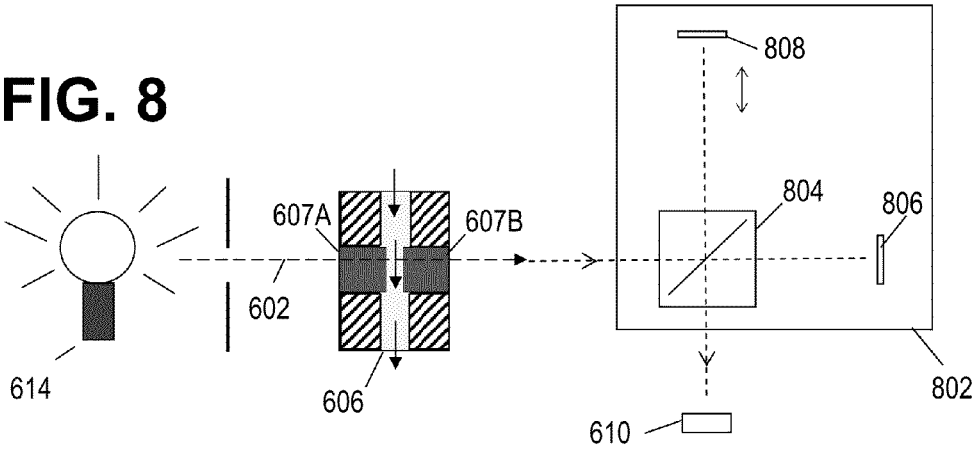
FIG. 8 shows a third illustrative optical radiometry tool configuration.

FIGS. 6-8 show illustrative configurations for downhole optical radiometry tools that can be employed in the wireline and LWD tools described above. FIG. 6 shows a configuration in which a wheel of SOUs is employed to provide multiple optical measurements. A light source 614 transmits light along a light path 602 that passes through a sample cell 606 having a fluid flowing between two windows 607A, 607B. The light passes through window 607A, interacts with the fluid, and passes through window 607B before impinging on an SOU 611 passing across the optical axis. The light from the SOU then strikes optical sensor 610, which is coupled to an analog-to-digital converter that enables a processor to capture measurement values. As the SOU wheel 612 rotates, the processor is able to determine which SOU is on the optical axis and to interpret the measurement values accordingly. In some embodiments the optical sensor measures light that is transmitted through the SOU, while in other embodiments the optical sensor measures light that is reflected from the SOU. In still other embodiments, one or more optical sensors are used to measure both transmitted and reflected light.

The wheel can include SOUs in the form of optical filters that selectively pass or block certain wavelengths of light, thereby enabling the processor to collect measurements of spectral intensity at specific wavelengths. Alternatively or in addition, the wheel can include SOUs in the form of multivariate optical elements (MOEs). MOEs offer a way to process the entire spectrum of the incident light to measure how well it matches to a given spectral template. In this manner, different MOEs can provide measurements of different fluid properties. In some system embodiments, the MOEs measure spectral character across the range from 350 nm to 6000 nm. Some contemplated downhole optical radiometry tools include MOEs that operate on light across the spectral range from 200 nm to 14,000 nm. To cover this range, some tool embodiments employ multiple light sources or a light source with multiple filaments or otherwise enhanced emission ranges.

Multiple MOEs are included in some downhole optical radiometry tools to provide a range of measurements such as, e.g., concentrations of water, $H_2S$, $CO_2$, light hydrocarbons (Methane, Ethane, Propane, Butanes, Pentanes, Hexanes and Heptanes), diesel, saturated hydrocarbons, aromatic hydrocarbons, resins, asphaltenes, olefins, and/or esters. Collective measurements of gases and oils can also be obtained by MOEs and processed by the processor to measure Gas-Oil Ratio or other properties such as equation of state, bubble point, precipitation point or other Pressure-Volume-Temperature properties, viscosity, contamination, and other fluid properties. Moreover, by monitoring the manner in which measurements change over time, the processor can detect and identify different fluid phases and the various rates at which those phases pass through the analysis region.

In at least some tool embodiments, the wheel includes multiple rows of angularly-aligned filters at corresponding radii. For example, one embodiment includes two rows, with the inner and outer SOUs at each given angular position being matched to provide detector normalization (e.g., the sole difference might be the coating on the outer SOU). In another two-row embodiment, the inner and outer SOUs are complementary filters or MOEs. The light from both paths alternately strikes the same detector, thereby enabling cancellation of temperature, aging, and other environmental effects. (Note that the complementary SOUs could have fully complementary spectra or just different pass bands. Either case allows for differential measurements that provide cancellation of common mode noise.)

The light sensor 610 receives the light that has been influenced by both the sample cell 606 and the SOU 611. Various forms of light sensors are contemplated including quantum-effect photodetectors (such as photodiodes, photoresistors, phototransistors, photovoltaic cells, and photomultiplier tubes) and thermal-effect photodectors (such as pyroelectric detectors, Golay cells, thermocouples, thermopiles, and thermistors). Most quantum-effect photodetectors are semiconductor based, e.g., silicon, InGaAs, PbS, and PbSe. In tools operating in only the visible and/or near infrared, both quantum-effect photodetectors and thermal-effect photodetectors are suitable. In tools operating across wider spectral ranges, thermal-effect photodetectors are preferred. One contemplated tool embodiment employs a combined detector made up of a silicon photodiode stacked above an InGaAs photodiode.

Some contemplated downhole optical radiometry tool embodiments employ two electrically balanced thermopiles as a photodetector. One thermopile is exposed to light traveling along the optical axis, while the other thermopile is shielded from such light and is used as a baseline reference when detecting the first thermopile's response to the light. Such a configuration offers an effective cancellation of environmental factors such as temperature, thereby providing enhanced sensitivity over a wide range of environmental conditions. Sensitivity can be further enhanced by heating the photodetector substrates and maintaining them at a constant temperature near or above the expected environmental temperature, or at least to a temperature where the effects of any further temperature increases are negligible. One contemplated environmental temperature range is from 40° to 400° F., with the detector temperature being maintained above 200° F.

The sensitivity may be further enhanced with the use of a secondary correction circuit, possibly in the form of an adaptive compensation circuit that adjusts a transducer bias current or voltage prior to signal amplification. The adjustments would be performed using standard adaptation techniques for compensating systematic sensing errors.

A shutter or chopper wheel can be used to modulation the light beam before it strikes the photodetector. Such modulation provides a way to measure the photodector signal in alternating light and dark states, thereby enhancing the sensitivity of the tool electronics to that portion of the signal attributable to the incident light. If the electrical signal is proportional to the light intensity, it provides a direct measure of the fluid property that the filter or MOE is designed to provide (assuming that the processor is calibrated to properly compensate for light source variations). The processor samples, processes, and combines the electronic output of the light sensor 610 to obtain the fluid properties of interest. As previously mentioned, these properties can include not only formation fluid composition, but also levels of contamination from drilling fluid (measurable by detecting such components as esters, olefins, diesel, and water), time-based trends in contamination, and reservoir compartmentalization or connectivity information based on composition or photometric signature.

As illustrated in FIG. 7, downhole optical radiometry tools are not limited to SOU wheel configurations, but can alternatively employ a spectral dispersion element 702 such as a prism, diffraction grating, or holographic element. The dispersed spectral components can be measured by a light sensing array 704 of multiple light sensors or, in some cases, a single light sensor that sweeps across the various spectral components. As before, light sensor(s) can take multiple forms, with an integrated array of sensors being preferred for optimized performance. A charge-coupled device (CCD) array is one example of an integrated sensor array which could be used in this configuration.

FIG. 8 shows yet another downhole optical radiometry tool configuration which is similar to the embodiments of FIGS. 6-7, except that it employs a Michelson-type interferometer 802 to transform the light beam into an interferogram, i.e., a signal in which the various spectral components exhibit a time domain oscillation at a rate defined by their wavelength and the speed with which the interferometer's path length changes. The interferometer includes a beam splitter 804 that divides the incident light into two beams. One beam reflects off a fixed mirror 806 and the other off a mirror that moves at a velocity v. The light beams then recombine at the beam splitter to form the interferogram which is then directed to the light sensor 610. As the path length difference rate of change is 2v, the spectral component of the light beam having wavelength λ oscillates at a frequency of f=2v/λ. (Note that the velocity v varies as the mirror moves back and forth, so such variation should be taken into account.) If a Fourier transform is applied to the time domain signal provided by the light sensor, the result is the optical spectrum of the light from the sample cell. A processor can then analyze the spectral characteristics digitally to identify the various fluid properties discussed previously.

Figure 9:
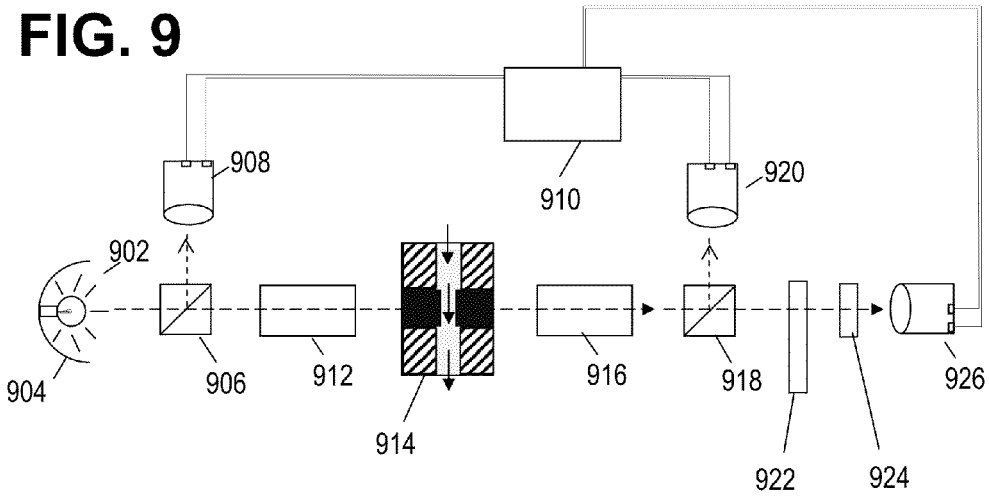
FIG. 9 is a schematic diagram of an illustrative downhole optical radiometry tool.

FIG. 9 illustrates an enhanced measurement configuration for a downhole optical radiometry tool. A light source 902 emits light that is collimated by a parabolic reflector 904 and directed along a light path to a beam splitter 906. The beam splitter directs a portion of the light to a light sensor 908 having an electrically balanced thermopile configuration. A processor 910 digitizes and processes the signal from sensor 908 to monitor fluctuations in the brightness of the light source.

Beam splitter 906 passes the main portion of the light beam to an optical guide 912 such as, e.g., a calcium fluoride rod. The optical guide 912 communicates the light to sample cell 914, where the light passes through fluid between two transparent windows. Light exiting the sample cell passes along a second optical guide 916 to a second beam splitter 918 that directs a portion of the light to a second light sensor 920. Processor 910 digitizes and processes the signal from sensor 920 to monitor optical density of the fluid and calibrate the brightness of the light incident on the SOU.

Beam splitter 918 passes the bulk of the light beam to wheel 922 where it interacts with a SOU such as a filter or MOE before passing through a shutter to reach light sensor 926. The shutter 924 modulates the light beam to increase the sensitivity of light sensor 926. Processor 920 digitizes and processes the signal from sensor 926 in combination with the measurements of sensors 920 and 908 to determine one or more fluid property measurements. As the wheel 922 turns, other SOUs are brought into the light path to increase the number of measurement types that are collected and processed by processor 910. Each of the sensors can employ the electrically balanced thermopiles to improve the tool's performance across a wide temperature range.

Figure 10:
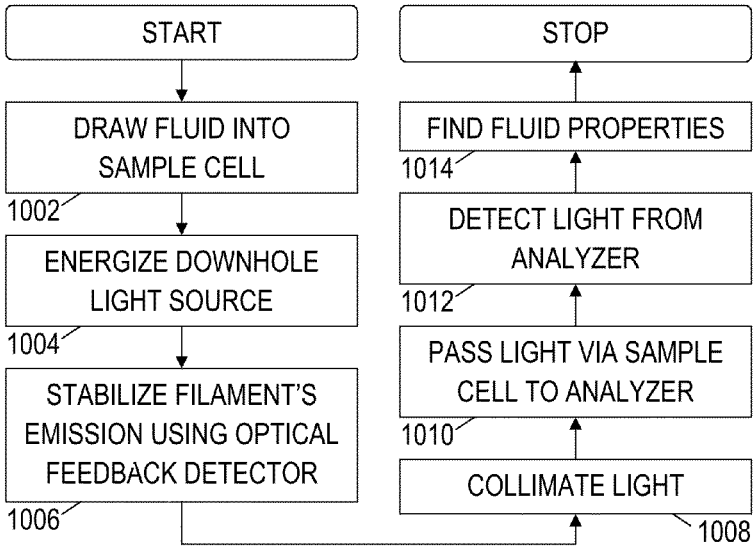
FIG. 10 is a flowchart of an illustrative downhole optical analysis method.

FIG. 10 shows an illustrative downhole fluid analysis method to determine various fluid properties. In block 1002, a downhole optical radiometry tool pumps fluid through a downhole sample cell. In block 1004, the tool energizes a downhole light source such as an electrical filament. In block 1006, the tool takes a measurement of the light source intensity and either adjusts the bulb temperature, determines a compensation value for the measurement, or both. In block 1008, the light emitted from the light source is provided with collimation and directed along an optical path through the tool. In block 1010, the tool transmits light through two windows in the sample cell and the fluid that is present in the gap between the two windows. The light exiting the sample cell is directed to at least one spectral operation unit such as, e.g., a filter or multivariate optical element. In block 1012, the tool senses light from the SOU with a light sensor. The light intensity signal from the sensor is conditioned, sampled, and digitized by the processor. In block 1014, the tool processes the measurements to ascertain one or more properties of the fluid in the sample cell. The processor can record the measurements in internal memory and/or transmit the data to the surface via wireline or LWD telemetry.

Numerous variations and modifications will become apparent to those skilled in the art once the above disclosure is fully appreciated. It is intended that the claims be interpreted to embrace all such variations and modifications.

What is claimed is:

1. A downhole optical radiometry tool that comprises:
- a tool body that includes a downhole sample cell for fluid flow;
- a light source inside said tool body;
- a spectral operation unit (SOU); and
- a light detector, which includes at least two electrically balanced thermopiles, where at least one thermopile is arranged to receive a light beam emitted from said light source after said light beam has encountered said sample cell and said SOU, wherein at least one thermopile is shielded from the light beam, and wherein said light detector combines outputs from the electrically balanced thermopiles to provide an electric signal proportional to a property of said fluid.

2. The tool of claim 1, wherein said light source has two or more filaments with different emission spectra.

3. The tool of claim 1, wherein said SOU comprises multiple MOEs to measure different fluid properties.

4. The tool of claim 1, wherein SOU comprises a filter array or spectral dispersion device.

5. The tool of claim 1, further comprising a shutter to gate said light beam between said sample cell and said light detector.

6. The tool of claim 1, further comprising a parabolic mirror that collimates light from said light source into said light beam.

7. The tool of claim 1, wherein the tool body is suspended by a wireline in a borehole.

8. The tool of claim 1, wherein the tool body is incorporated into a drill string.

9. The tool of claim 1, further comprising a second sample cell that receives said fluid flow in series with said downhole sample cell to measure at least one dynamic property of said fluid flow.

10. A downhole fluid analysis method that comprises:
- passing a sample of fluid through a downhole sample cell where a light beam interacts with said sample fluid; and
- receiving said light beam with a light detector after the light beam passes through a spectral operation unit (SOU), wherein the light detector includes at least two electrically balanced thermopiles with at least one thermopile shielded from the light beam; and
- combining outputs from the electrically balanced thermopiles to provide an electric signal proportional to a property of said sample fluid.

11. The method of claim 10, further comprising: generating said light beam using a light source having two or more filaments with different emission spectra.

12. The method of claim 10, further comprising: modulating said light beam after it has left the sample cell.

13. The method of claim 10, further comprising: collimating light from said light source into said light beam using a parabolic mirror.

14. The method of claim 10, further comprising: determining hydrocarbon types and a measure of contamination based on the intensity of said light beam.

15. A downhole optical radiometry tool that comprises:
- a tool body that includes a downhole sample cell for fluid flow;
- a light source inside said tool body;
- a multivariate optical element (MOE); and a light detector, arranged to receive a light beam emitted from said light source after said light beam passes through said sample cell and said MOE device, wherein said MOE is mounted in a circular wheel with other MOEs that measure other fluid properties, and wherein the circular wheel has a central flow passage.

16. The tool of claim 15, wherein said MOE provides a measure of hydrocarbon type.

17. The tool of claim 15, wherein said MOE provides a measure of contamination.

18. The tool of claim 15, wherein said wheel includes an open aperture for use as a reference.

19. The tool of claim 15, wherein said tool body includes a shutter to modulate said light beam between said sample cell and said light detector.

20. The tool of claim 15, wherein said light detector includes at least two electrically balanced thermopiles, at least one of which is arranged to receive said light beam emitted from said light source after said light beam is influenced by said sample cell and said MOE device.

21. A downhole fluid analysis method that comprises:

passing a sample of fluid through a downhole sample cell where a light beam interacts with said sample fluid;

detecting an intensity of said light beam after it has passed through said sample cell and a downhole multivariate optical element (MOE); and turning a circular wheel having an array of MOEs including said downhole MOE, wherein the circular wheel has a central flow passage.

22. The method of claim 21, further comprising forming said light beam by collimating light from a downhole light source using a parabolic mirror.

23. The method of claim 21, wherein the downhole MOE provides a measure of a fluid property in the group consisting of: contamination, H2S concentration, CO2 concentration, hydrocarbon type, and water concentration.

24. A downhole optical radiometry tool that comprises:

a tool body that includes a downhole sample cell for fluid flow;

a light source inside said tool body;

a multivariate optical element (MOE) mounted in a circular wheel with other MOEs, wherein the circular wheel has a central flow passage; and a light detector inside said tool body, wherein the light detector senses light from said light source that has interacted with said fluid flow and at least one of said MOEs.

25. The tool of claim 24, wherein said light detector includes at least two electrically balanced thermopiles, at least one of which is arranged to receive said light from said light source.

26. The tool of claim 24, wherein said MOEs provide measurements of different fluid properties, and wherein said wheel includes an open aperture for use as a reference.

* * * * *